United States Patent [19]

Maternaghan

[11] 4,184,877

[45] Jan. 22, 1980

[54] PROCESS FOR THE MANUFACTURE OF PHOTOGRAPHIC SILVER HALIDE EMULSIONS CONTAINING SILVER HALIDE CRYSTALS OF THE TWINNED TYPE

[75] Inventor: Trevor J. Maternaghan, Brentwood, England

[73] Assignee: Ciba-Geigy AG, Basle, Switzerland

[21] Appl. No.: 884,065

[22] Filed: Mar. 6, 1978

Related U.S. Application Data

[63] Continuation-in-part of Ser. No. 799,040, May 20, 1977, Pat. No. 4,150,994.

[30] Foreign Application Priority Data

Jun. 10, 1976 [GB] United Kingdom ..... 24001/76
Feb. 16, 1978 [GB] United Kingdom ..... 6090/78

[51] Int. Cl.[2] ..... G03C 1/02
[52] U.S. Cl. ..... 430/567; 430/569
[58] Field of Search ..... 96/94 R, 67, 108

[56] References Cited

U.S. PATENT DOCUMENTS

| | | | |
|---|---|---|---|
| 2,592,250 | 5/1952 | Davey et al. | 96/94 R |
| 3,482,982 | 12/1969 | Miyata | 96/94 R |
| 3,573,057 | 3/1967 | Stevens | 96/94 R |
| 3,790,387 | 2/1977 | Muslinger | 96/94 R |

*Primary Examiner*—Edward C. Kimlin

*Attorney, Agent, or Firm*—Sprung, Felfe, Horn, Lynch & Kramer

[57] ABSTRACT

A method of preparing photographic silver iodobromide or iodochloride emulsions the silver halide crystals of which are of the twinned octahedral or cubic type, which emulsions have improved homogeneity of iodide content and controlled size distribution of the crystal grains, comprising the following steps: (a) forming a colloid dispersing medium silver halide crystals containing at least 90 mole % iodide these said crystals being predominantly of the hexagonal lattice structure, (b) mixing in the dispersing medium containing the said silver halide crystals an aqueous solution of a silver salt and an aqueous solution of an alkali metal or ammonium halide so forming twinned silver halide crystals containing iodide and the halides being added, the rate of addition of silver salt and alkali metal or ammonium bromide being so controlled that the silver halide crystals formed in this step are predominantly twinned and optionally (c) then causing the twinned crystals to increase in size by adding to the colloidal dispersion further aqueous silver salt solution and further alkali metal or ammonium halide and then finally optionally (d) removing the water-soluble salts formed and chemically sensitizing the emulsion.

The new photographic emulsions exhibit a high covering power and contrast on development.

19 Claims, 18 Drawing Figures

DENSITY VS. LOG. EXPOSURE CURVES

DENSITY vs. LOG. EXPOSURE CURVES

PROCESS FOR THE MANUFACTURE OF PHOTOGRAPHIC SILVER HALIDE EMULSIONS CONTAINING SILVER HALIDE CRYSTALS OF THE TWINNED TYPE

This is a continuation-in-part application of copending patent application Ser. No. 799,040, filed May 20, 1977, now U.S. Pat. No. 4,150,994.

This invention relates to improved photographic silver halide emulsions, and to a process for the production of such emulsions.

Silver halide emulsions are composed of silver halide crystals dispersed in a colloid medium which is often gelatin. The properties of the photographic emulsions depend very markedly on the several steps which are used to prepare the photographic emulsion, and the relation and order of one or more of such steps with respect to each of the others.

Thus, a common process for the preparation of such an emulsion comprises the initial precipitation (nucleation) of microscopic silver halide crystals, usually by mixing of a silver salt solution with a water-soluble halide salt solution; growth of these crystals by further addition of reagent solutions; washing of the emulsion to remove water-soluble salts formed as a by-product of the double-decomposition reaction of the previous precipitation stages; and sensitisation in order to increase the intrinsic sensitivity of the final emulsion by treatment with chemical sensitising agents such as sulphur and gold salts and in many cases by the addition of spectral sensitising dyes.

The precise steps of such an emulsion-making process can be designed to meet various desirable objectives so that emulsions having the requisite photographic properties may be obtained. Thus, the precipitation stages in the process may be adapted to control the average size of the silver halide crystals (which in general determines the speed of the photographic emulsion), the size distribution of those crystals (and hence the photographic contrast), the shape and habit of the crystals (including the external lattice faces and the extent of twinning) and the halide composition of the crystals. It is particularly advantageous to control the uniformity of the halide distribution within the population of crystals, and the halide compositional profile within each crystal. The shape and internal structure of the crystals have also an important influence on the photographic behavious of the emulsion. In particular, twinned silver halide crystals are favoured in many applications, because of their high photographic sensitivity and covering power (ratio of developed density to weight of developed silver).

This invention relates especially to silver halide crystals which are of particular shape and habit. However in order to achieve this selection of shape and habit it has been found necessary that some restriction of the halide composition is also required. Specifically, this invention relates to an improved method for the production of silver iodobromide, silver iodochloride or silver iodochlorobromide emulsions of the twinned type by a controlled incorporation of silver iodide in the silver halide crystals during growth.

Improved photographic properties are often observed when a mixture of water-soluble halides is used in the precipitation of the silver halide. In general there are two recognised techniques for controlling the precipitation of silver halide, as described by Gutoff in U.S.

Pat. No. 3,773,516; the single-jet and the double-jet emulsification methods. In the single-jet process aqueous silver nitrate solution is added to a solution containing a small amount of gelatin and a mixture of soluble halides. The crystal size distribution may be controlled by an Ostwald ripening step after part or all of the silver nitrate has been introduced, in which the emulsion is held at elevated temperatures. During this step the least soluble, large crystals grow by diffusion and incorporation of silver halide dissolved from the more soluble, small crystals. The ripening stage results in an increase in average crystal size of the emulsion (and often an increase in the photographic sensitivity of the emulsion ultimately) and a widening of the crystal size distribution. The crystal habit of photographic emulsions made by a single-jet technique often is predominantly that of twinned octahedral crystals, due to the large excess of halide ions present during the precipitation and ripening stages. This is especially true of iodobromide precipitations. A description of twinned crystals is given in "An Introduction to Crystallography", 3rd edition, Longmans (1966) pp 162–165 by F. C. Phillips and "The Crystalline State", by P. Gay, Oliver and Boyd (1972) pp 328–338. The disadvantage of such a single-jet process is that the twinned crystals produced invariably have a relatively wide size distribution. In the alternative double-jet process, aqueous solutions of silver nitrate and soluble halide salts are added simultaneously to a stirred solution of gelatin. The flow rates of the reagent solutions may be regulated so that the quantity of excess halide is maintained constant, and predominantly untwinned crystls are formed.

Silver halide crystals of flat or tabular shape exhibit on development extremely good covering power and thus the silver utilisation is extremely good compared with silver halide crystals of other shapes for example cubic crystals. Many twinned octahedral crystals are of this type particularly if the crystals contain more than one twin-plane and the twin planes are parallel. FIG. 1 shows silver halide crystals of the tabular twinned type. A particular object of the present invention is to increase the proportion of twinned crystals with parallel twin planes in an emulsion.

Another objective of improvements in the commercial production of photographic emulsions is to increase the contrast of the final material, this being a desirable property for graphic arts and radiographic products. This may be achieved partly as a result of a decrease in size distribution, as for example described in British patent specification no. 1469480 and partly by ensuring that the iodide content and iodide distribution of different silver halide crystals in the emulsion are made more similar. The point of addition of the soluble iodide salt in various emulsification processes is known to affect the sensitivity and size distribution of the emulsion (Research Disclosure no. 13452 (1975)).

Thus the application of photographic emulsions containing twinned crystals to products requiring enhanced sensitivity and contrast has been hindered by the defects in conventional emulsification procedures particularly the uncontrolled incorporation of iodide in the crystals. We have discovered an improved method for the preparation of silver iodobromide, silver iodochloride or silver iodochlorobromide photographic emulsions, wherein iodide ions are supplied to the growing crystals by the partial or complete dissolution of a dispersion of silver iodide crystals. Also we have found the conditions under which the desired tabular twinned habit is avoured by this process, and by which substantially uniform photographic emulsion crystals of this type may be prepared.

According to the present invention there is provided method of preparing a silver halide emulsion of the winned type which comprises the steps of (a) forming a colloid dispersing medium silver halide crystals ontaining at least 90 mole % iodide, said crystals being redominantly of the hexagonal lattice structure, (b) ixing in the dispersing medium containing the said ilver halide crystals an aqueous solution of an alkali etal or ammonium bromide or chloride or mixtures ereof so forming twinned silver halide crystals conining iodide and the halide or halides being added, ptionally (c) adding a silver halide solvent to the disersing medium and so causing the growth of the winned crystals by Ostwald ripening, optionally (d) en causing the twinned crystals to increase in size by dding to the colloid dispersion further aqueous silver lt solution and further alkali metal or ammonium hale and then finally optionally (e) removing the water oluble salts formed and chemically sensitising the nulsion.

Figure 2:
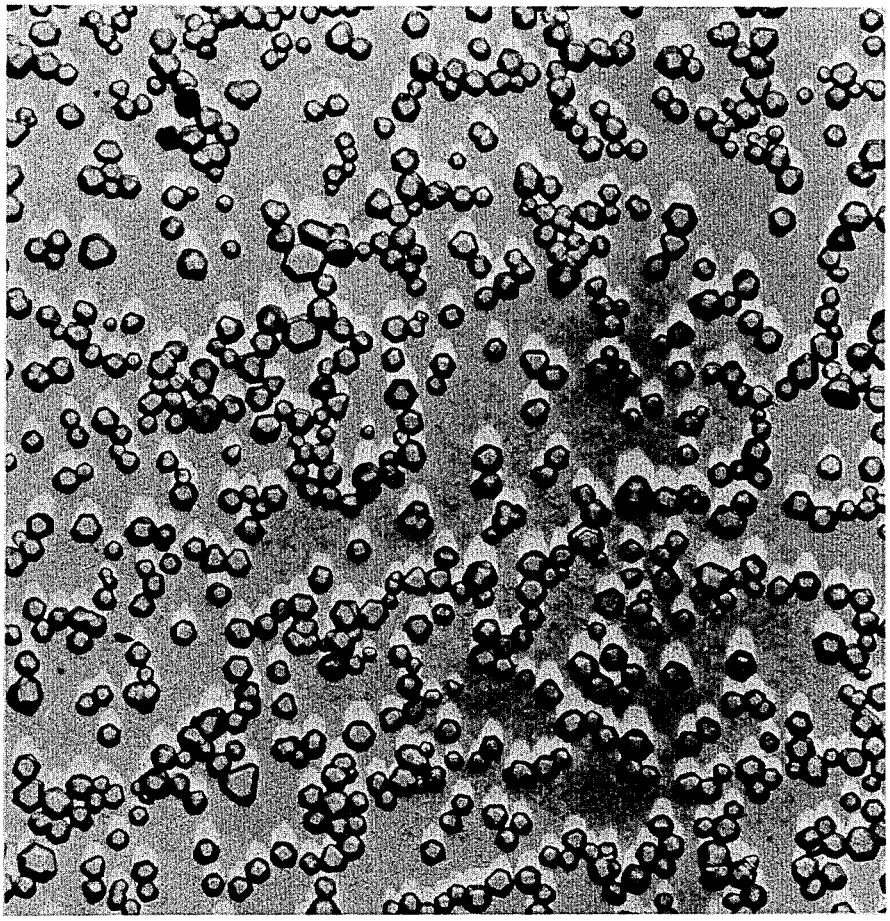
FIG. 2 shows silver iodide crystals of the hexagonal ttice structure.

In the process of the present invention silver halide crystals of high iodide content are first formed. Silver halide crystals which have a high iodide content that is to say from 90 to 100 mole % iodide are predominantly of hexagonal lattice structure. Techniques for the preparation of silver iodide crystals predominantly of hexagonal lattice structure are well-known, and are for example described by B. L. Byerley and H. Hirsch, *J. Phot. Sci.* vol 18 p. 53 (1970). Such crystals have the shape of hexagonal pyramids or bipyramids. The basal planes of these pyramids comprise the lattice planes {0001}. Silver iodide crystals of the hexagonal lattice structure are shown in FIG. 2.

However, silver halide crystals containing smaller amounts of iodide (i.e. up to approximately 45 mole % iodide) are predominantly of the face-centred lattice structure, and have the crystal forms of octahedra (external forms comprising {111} lattice planes) or cubes (external forms comprising {100} lattice planes). It is known that these crystal shapes may become modified by twinning, so that twinned crystals of the face-centred cubic lattic structure may have the form of triangular or hexagonal plates, the form depending on the number and geometry of the twin planes which are formed.

Figure 3A:
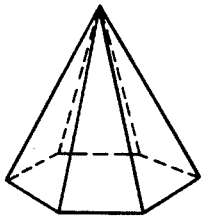
FIG. 3 shows one hexagonal, pyramidal silver iodide ystal (3*a*) and one hexagonal bipyramidal crystal (3*b*).
Figure 3B:
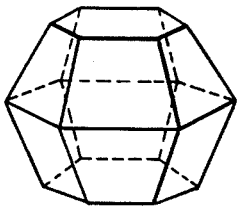
Figure 4A:
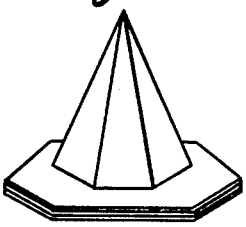
FIG. 4 shows one twinned face-centered cubic crysl formed on a hexagonal pyramidal silver iodide crysl (4*a*) and one twinned face-centered cubic crystal rmed at each basal face of a hexagonal bipyramidal ver iodide crystal (4*b*).

In the process of the present invention in step (b) aqueous solutions of a silver salt and an alkali metal or ammonium bromide or chloride (or mixtures thereof) are added to the dispersion medium containing the silver iodide crystals which are predominantly of the hexagonal lattice structure, so that silver bromide (or chloride or chlorobromide) is precipitated. However, as overall growth of the silver iodide crystals of this structure cannot take place, nuclei of the silver halide being added form as very small crystals of the face-centered cubic lattice type as the proportion of iodide of these crystals is relatively small. However, during this step the first-formed silver iodide crystals dissolve the silver iodide is incorporated into the growing face-centred cubic lattice crystals. Electron micrographs have revealed that in step (b), whilst no overall circumferential growth of the silver iodide crystals occurs, the face-centred cubic lattice type crystals of the halide being added in step (b) form and grow epitaxially on the basal faces of the silver iodide crystals formed in step (a). Epitaxial growth is possible between {0001} Ag I faces and }111} AgBr or AgCl faces because both are hexagonally close-packed, homoionic lattice planes. It has been observed by electron microscopy that the growing epitaxial crystals show a high degree of twinning (recognised by the parallel striations characteristic of several twin planes intersecting the surface) while attached to the parent silver iodide crystal. It is thought that this twinning is encouraged by the continual supply of iodide ions to the growing (face-centred cubic) phase, either by bulk diffusion through the dispersing medium or by anionic diffusion through the crystal junction. In general, one twinned face-centred cubic crystal is formed at the single basal face of a hexagonal pyramidal silver iodide crystal, and two twinned crystals are formed at the two basal faces of each hexagonal bipyramidal silver iodide crystal. FIG. 3 shows one hexagonal pyramidal silver iodide crystal (3*a*) and one hexagonal bipyramidal crystal (3*b*). As further precipitation of the silver halide is continued and the total iodide proportion of the silver halide suspended in the dispersion medium decreases below 30–40 mole % iodide, the dissolution of the originally formed silver iodide crystals becomes predominant and the 'dumbbell'-shaped crystals of FIG. 4 are observed. FIG. 4 shows one twinned face-centred cubic crystal formed on a hexagonal pyramidal silver iodide crystal (4*a*) and one twinned face-centred cubic crystal formed at each basal face of a hexgonal bipyramidal silver iodide crystal (4*b*). As step (b) proceeds the twinned face-centred cubic crystals increase in size and the iodide crystals decrease in size. This stage is shown in FIG. 5. Eventually the silver iodide linkage between the two twinned crystals (4*b*) is broken and the two twinned crystals are released. The residue of the silver iodide may remain on the twinned face-centred cubic crystals or it may eventually dissolve away.

Figure 4B:
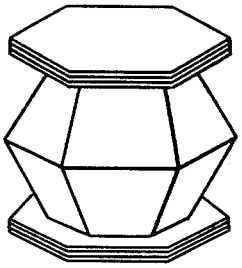
Figure 5A:
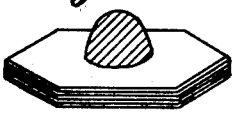
FIGS. 5(*a*) and 5(*b*) shows the increase in size of the winned face-centered cubic crystals and the decrease size of the iodide crystals as the steps in FIGS. 4(*a*) d 4(*b*) proceed.
Figure 5B:
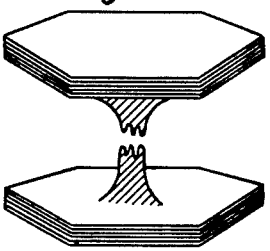
Figure 6:
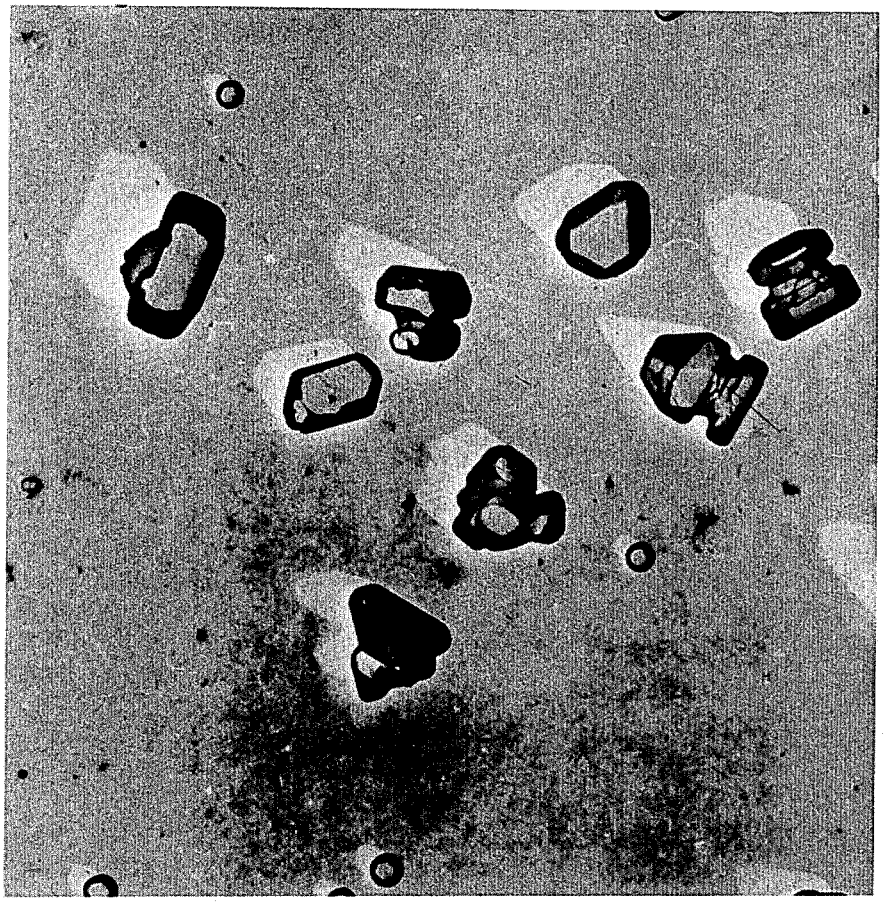
FIG. 6 is an electronmicrograph showing the dumbll crystals of FIG. 4(*b*) in the process of recrystallizan.

FIG. 6 is an electromicrograph showing the dumbbell crystals of FIG. 4*b* in the process of recrystallisation.

In the process of the present invention, the supply of iodide ions in step (b) hereinafter called the recrystallisation step is provided by further dissolution of the silver iodide crystals to maintain the equilibrium concentration given by the relationship $$[Ag+][I-]=k$$

where [Ag+], [I−] are the activities (in dilute solution the concentrations) of silver and iodide ions, and k is a constant (k is the well-known solubility product).

Figure 1:
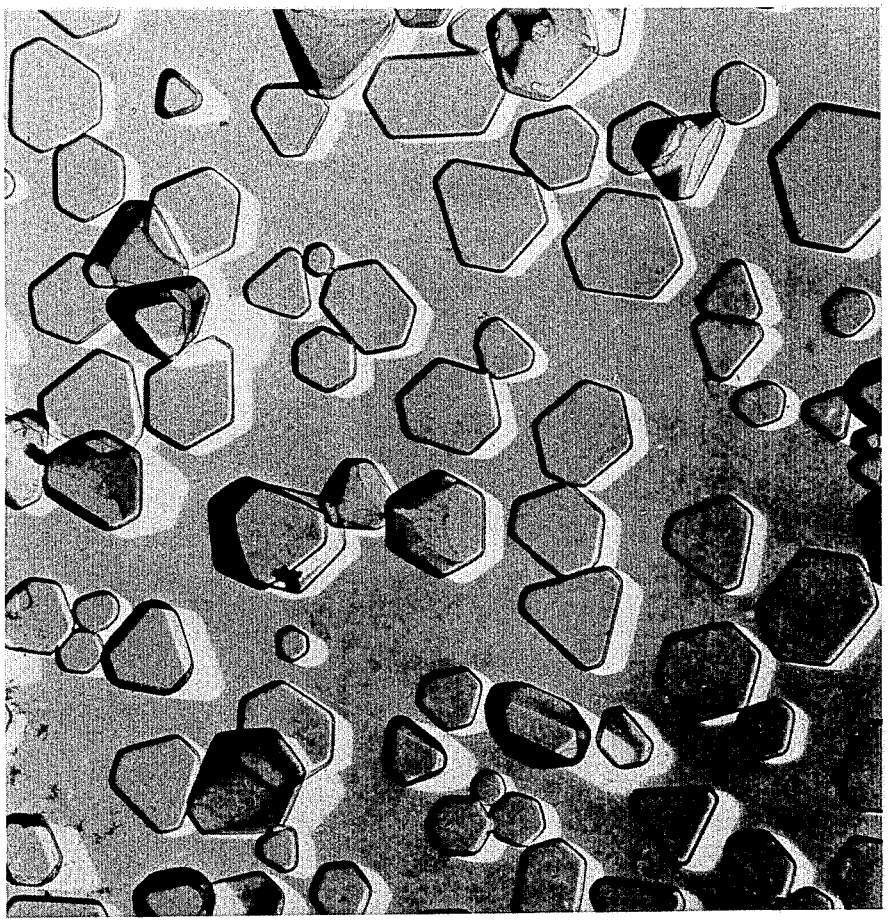
FIG. 1 shows silver halide crystals of the tabular winned type.

As hereinbefore stated the incorporation of iodide in the growing crystals in step (b) encourages the formation of octahedral faces, and in particular, the formation of stacking faults known as twin planes. Moreover, in one aspect of the present invention the formation of crystals with parallel twin planes is especially favoured. This results in a modification of crystal shape, so that many of the crystals formed are of the tabular twinned type illustrated in FIG. 1. It is known that the formation of twin planes is not possible when the external faces of the crystals are the cubic (100) lattice planes (Berry and Skillman, Photographic Science and Engineering 6, page 159 (1962)), but can occur only when the external faces comprise at least partially the octahedral (111) lattice planes. Thus the incorporation of iodide in the recrystallisation step (b) has the effect of encouraging twin formation, even under conditions where, with crystals containing no iodide, cubic external faces are normally displayed.

In step (b) as iodide ions are removed from the solution phase by precipitation, they are rapidly replaced by the dissolution of further silver iodide crystals, so that depending on the addition rates of the silver and halide solutions the silver iodide crystals are completely dissolved by the end of the precipitation or recrystallisation step (b).

It is possible to carry out the process of the present invention employing two different modes. According to the first mode there is provided a method of preparing a silver halide emulsion of the twinned type which comprises the steps of (a) forming in a colloid dispersing medium silver halide crystals containing at least 90 mole % iodide, these said crystals being predominantly of the hexagonal lattice structure (b) mixing in the dispersing medium containing the said silver halide crystals an aqueous solution of a silver salt and an aqueous solution of an alkali metal or ammonium bromide or chloride (or mixtures thereof) so forming twinned silver halide crystals containing iodide and the halide or halides being added, (c) adding a silver halide solvent to the dispersing medium and so causing the growth of the twinned crystals by Ostwald ripening and optionally (d) then causing the twinned crystals to increase in size by adding to the colloidal dispersion further aqueous silver salt solution and further alkali metal or ammonium halide and then finally optionally (e) removing the water-soluble salts formed and chemically sensitising the emulsion.

By Ostwald ripening is meant the dissolution of the smaller more-soluble crystals. In the process of this invention usually the smaller more-soluble crystals contain less iodide than the larger less-soluble crystals.

According to the second mode there is provided a method of preparing a silver halide emulsion of the twinned type which comprises the steps of (a) forming in a colloid dispersing medium silver halide crystals containing at least 90 mole % iodide, these said crystals being predominantly of the hexagonal lattice structure, (b) mixing in the dispersing medium containing the said silver halide crystals an aqueous solution of a silver salt and an aqueous solution of an alkali metal or ammonium salt and an aqueous solution of an alkali metal or ammonium bromide or chloride or mixtures thereof, so forming twinned silver halide crystals containing iodide and the halide or halides being added, the rate of addition of silver salt and alkali metal or ammonium halide being so controlled that the silver halide crystals formed in this step are predominantly twinned and optionally (d) then causing the twinned crystals to increase in size by adding to the colloidal dispersion further aqueous silver salt solution and further alkali metal or ammonium halide and then finally optionally (e) removing the water-soluble salts formed and chemically sensitising the emulsion.

Thus in one mode of the process of the present invention a silver halide solvent is used in step (c) to dissolve the unwanted untwinned silver halide crystals which are formed in step (b). However in the second mode step (b) is so controlled that very few if any unwanted untwinned crystals are formed. In this mode it is not necessary to include step (c). The silver halide crystals formed after step (c) of the first mode are similar to the silver halide crystals formed after step (b) of the second mode in that the crystals are predominantly twinned crystals of the face-centred cubic lattice type. In the first mode, it is possible to combine steps (b) and (c), so that an Ostwald ripening solvent is added before the completion of step (b). Examples of this method of the present invention are given hereafter. In this case, crystal growth takes place either by transfer of material from small crystals to the large crystals due to the presence of the Ostwald ripening solvent or by direct incorporation of the silver halide being precipitated during step (b). However growth of silver halide crystals by double-jetting alone is, in fact, conceptually very similar to growth by Ostwald ripening, in that small crystals may be dissolving in both growth processes. In the double-jet process the imperfect mixing of concentrated reagent solutions commonly used in silver halide precipitation inevitably leads to localised regions in the emulsion vessel in which the capacity of the existing crystals to take up new material is greatly exceeded. Thus as silver halide has a low solubility in water the excess silver halide tends to precipitate as very small nuclei. Because of the high surface energy of small crystals, such nuclei will in general be only transiently stable, and as mixing proceeds will dissolve, allowing further growth of the existing crystals. Thus, in fact, the two modes of the present invention are in principle very similar, because of the growth of the twinned crystals ıking place in step (b) of the second mode probably ccurs partly by such a ripening process, even though olution addition rates are so controlled that no substanal formation of new crystals can be observed in step ). This is particularly true in a preferred process of the resent invention according to the second mode in /hich this growth is carried out in the presence of a xed concentration of excess halide, which is itself a ılver halide solvent, or during the preparation of silver alide emulsions containing a substantial proportion of hloride, which increases the silver halide solubility, nd therefore the tendency to undergo Ostwald ripenıg.

Preferably in the first mode the Ostwald ripening step :) is carried outunder conditions favouring the producon of octahedral faces so that selective growth of winned crystals is favoured. Thereafter, if desired, the onditions may be changed to favour cubic faces espeially in step (d) with the consequent formation of winned cubic crystals.

Moreover the silver halide crystals of the photoraphic emulsion produced by the process of the presnt invention can be predominantly of the desirable ıbular twinned type when the growth step (d) or the )stwald ripening step (c) of the first mode, or growth :ep (d) of the second mode, is carried out in conditions ıvouring the octahedral habit and usually more than 0% by weight or number of the silver halide crystals resent are of this type under these conditions.

Preferably, the recrystallisation step (b) in which the winned crystals are nucleated is effected by the addion of aqueous 3 M–5 M solutions of silver nitrate and mmonium bromide or chloride or mixtures thereof to a :irred dispersion of silver iodide in gelatin solution, at a xed temperature and pAg value maintained in the ınge 5.0 to 11.0 and most preferably in the range 6.0 to 0.0. The fixed temperature may be set within a wide ınge e.g. 35° to 90° C. It is most advantageous to mainın the flow rate of the silver nitrate solution constant uring this stage with the necessary adjustments being ıade to the addition rate of the halide solution. Howver, as stated, in the second mode the rate of addition f aqueous solutions in step (b) must be so controlled ıat by the end of this step the silver halide crystals ›rmed are predominantly twinned.

It is to be understood that steps (a) and (b) need not ›llow directly one after the other. For example the lver iodide colloid dispersion may be made before equired and then stored. Further in the first mode it is ossible to commence step (c) before the completion of :ep (b). In such a case a silver halide solvent such as mmonia may be added with the fresh halide solution fter part of the halide has been added to form the winned silver halide crystals. If fairly small silver halle crystals are required then step (d) may not be necesıry. However step (d) is of particular use in the prouction of monodisperse twinned silver halide emulions as hereinafter described.

Preferably in step (a) pure silver iodide crystals are ›rmed but up to 10 mole % of other halides (chloride r bromide) may be present in the silver iodide crystals /hile still retaining their hexagonal lattice form. Thus it ; to be understood that the term silver iodide crystals ıcludes crystals containing up to 10 mole % of other alides. It is to be understood that a small fraction of the rystals formed (i.e. up to 10% by weight or number of ıe crystals) in step (a) may be predominantly silver hloride or silver bromide and of the face-centred cubic lattice type without marked effect on the process according to the invention. Preferably in step (b) no additional iodide is added in the halide solution, but the possibility of adding small amounts is not excluded (i.e. up to 10 mole % of the halide added in this step may be iodide).

It is preferred that the median linear size of the silver iodide crystals formed in step (a) should be in the range 0.05–5.0 microns but most preferably in the range 0.1–1 microns.

It is preferred that the silver iodide content in the dispersing medium at the commencement of step (b) should be in the range 0.05–2.0 moles/liter and most preferably in the range 0.10–1.0 moles/liter.

It is a particular feature of the present invention according to either mode that in order to prepare a crystal population of the highest uniformity in step (b) which may be used to prepare monodisperse emulsions, the addition rates of the silver halide solutions added in step (b) should be predetermined by experiment. The optimum flow rates in this respect depend on the nature of the halide, and increase with the number of silver iodide crystals in the aqueous dispersion medium, decreasing crystal size of silver iodide crystals, the pAg in the range specified above, and the temperature. For example higher rates of addition are required in the preparation of silver iodochloride or silver iodochlorobromide emulsions than in their silver iodobromide equivalents.

It is preferred in the recrystallisation step (b) that the volumes of silver nitrate and ammonium or alkali metal halides added should be such that the silver iodide comprises from 0.01–20 mole % of the total silver halide in the final emulsion. As an indication of the appropriate flow rate the rate should be adjusted until the dissolution of the silver iodide is substantially complete by the time at which a quantity of silver nitrate one to three times that equivalent to the silver iodide has been added. The optimum rate can thus be deduced from electron micrographs taken at different times during the recrystallisation, as the distinctive crystal habit of the silver iodide crystals allows them to be differentiated from silver halide crystals of the usual face-centred cubic lattice.

It is apparent from the previous discussion of the mechanism of the process according to the present invention that electron micrographs of emulsion samples extracted during experimental preparations in which the addition rate during step (b) is varied can be used to give another indication of the optimal flow rates. According to the first mode of the present invention it is preferable that a constant flow rate is employed in step (b) and electron micrographs of the final, ripened emulsion at the end of step (c) can be used to select the optimal rate of addition during step (b) which would produce a population of twinned crystals of greatest uniformity and shape. The optimal flow rate during step (b) which is most appropriate for the conditions chosen for the ripening step (c) can thus be determined by prior experiment. It is a particular feature of the present invention according to the second mode, that in step (b) the addition rate of the reagent solutions should be so controlled that the silver halide crystals formed in this step are predominantly of the twinned type and that no substantial formation of new untwinned crystals takes place. Preferably the addition rates should be so chosen also that no Ostwald ripening among the existing population of twinned crystals should occur. The experimental predeterminations necessary to ensure that the optimal range of flow rates may be employed are similar to those described in British Patent Specification No. 1469480. An excessively low addition rate in step (b) would lead to incomplete recrystallisation of the silver iodide crystals formed in step (a) and excessive widening of the size distribution of the twinned crystals which are formed, due to Ostwald ripening. An excessively high addition rate in step (b) would lead to a substantial renucleation of untwinned crystals which could be readily detected due to their characteristic regular cubic or octahedral shape. In this case, only part of the final crystals will have been formed under the direct influence of the silver iodide, leading to a wide distribution of iodide content, and the size distribution of the final emulsion will invariably be bimodal. Both effects would lead to a loss of photographic contrast in the final emulsion. A population of twinned crystals more uniform in size and shape results from the selection of an appropriate, intermediate rate of addition during step (b), and this is illustrated in one of the examples given hereafter.

In order that ripening occurs at a conveniently fast rate during step (c) of the first mode, it is necessary to add silver halide solvents such as an excess of halide salts or ammonia, or other silver halide complexing agents such as ammonium thiocyanate. The relative concentration of solvents may affect the crystal habit observed after ripening. The effect of excess bromide and ammonia in Ostwald ripening on the habit of silver iodobromide crystals is described by Marcocki and Zaleski (Phot. Sci. Eng. 17, 289 (1973); the effect of a slight excess of bromide is to favour the formation of the octahedral habit.

The Ostwald ripening in step (c) of the present invention is most preferably carried out in conditions favouring octahedral habit. The preferred silver halide solvent is ammonia, added to a final concentration in the range 0.1–1.5 M, and the preferred temperature for the ripening is between 50°–70° C. The preferred pAg value for the ripening stage is in the range 7–10. Excessively high temperatures or halide or ammonia concentration usually results in a widening of the final size distribution.

In order to increase the rate of addition of the aqueous solutions in step (b) in the second mode, whilst still ensuring that the crystals obtained at the end of step (b) are predominantly of the twinned type, it is advantageous to employ small proportions of alkali metal halides in steps (a) and (b) which have cation radii which are appreciably different from the commonly used sodium, potassium or ammonium salts. Thus the optimal rate of addition employed during step (b) can be raised by employing a small proportion of an alkali metal halide with a cation radius smaller than that of silver, such as lithium, during the preparation of the silver iodide crystals in step (a), or by employing a small proportion of an alkali metal halide with a cation radius larger than that of silver, such as rubidium, during the recrystallisation step (b). A table of cation sizes is given by R. A. Robinson and R. H. Stokes in "Electrolyte Solutions" page 461, 2nd ed., Butterworths (1959). It is believed that small amounts of these ions become occluded in the respective silver halide lattices during precipitation, and increase the rate of conversion of the hexagonal lattice type crystals formed in step (a). Other possible methods of increasing the rate of epitaxial growth (or dissolution rate of the silver iodide crystals) during step (b) are to carry out step (b) in the presence of a wetting agent such as a polyalkene oxide condensate or a silver iodide solvent. It is believed that polyalkene oxides can accelerate the conversion of silver iodide to silver iodobromide or iodochloride by complexing iodide ions or displacing gelatin from the surface of crystals undergoing recrystallisation, whereas incorporation of a proportion of a silver iodide solvent in the dispersion medium during step (b) can affect the rate of conversion by a direct influence on the solubility.

A high concentration of ammonia encourages the formation of the cubic habit in silver iodobromide crystals, and for this reason it is preferred that the recrystallisation step (b) for silver iodobromide emulsions should be carried out in a low concentration of ammonia. Conversely for silver iodochloride or silver chloride crystals, a high concentration of ammonia encourages the formation of the octahedral habit (Berg et al. Die Grundlagen der Photographischen Prozesse mit Silberhalogeniden Band 2 p. 640) and therefore in the preparation of twinned silver iodochloride emulsions according to the first mode the recrystallisation step (b) and ripening step (c) should be carried out at an ammonia concentration within the preferred range of 0.5–1 M throughout. This is conveniently achieved by the addition of a concentrated ammonia solution to the alkali metal or ammonium chloride solution. However twinned cubic silver iodochloride emulsions may be prepared in the absence of ammonia.

Similarly within the scope of the present invention twinned silver halide photographic emulsions of the intermediate tetradecahedral habit may be produced by selection of the appropriate solution conditions.

The process of the present invention is particularly suitable for the production of twinned silver halide emulsions of the monodisperse type. In this aspect of the invention step (d) is included and during this step further silver and halide solutions are added by a double-jetting method and at a controlled pAg. Preferably the additional halide added during this stage is such that the iodide content of the final crystals is about 1 to 10 mole % which is the amount of iodide which has been found to be most beneficial, yielding high-speed emulsions which exhibit rapid development.

A method of preparing monodisperse twinned octahedral silver halide crystals is described in British patent specification no. 1469480 and the silver halide crystals produced after step (c) in the case of the first mode or after step (b) in the case of the second mode in the process of the present invention can be caused to increase in size following the method described in British Pat. No. 1469480.

Figure 7:
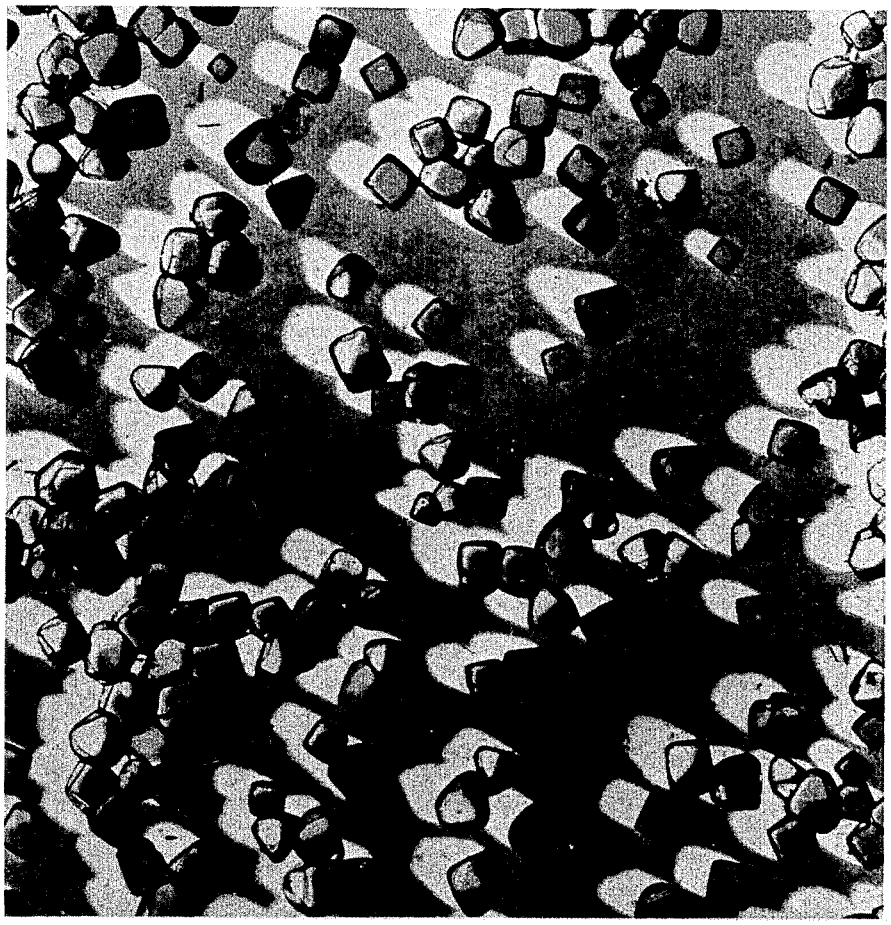
FIG. 7 shows the twinned cubic crystals formed en the silver halide emulsion is prepared with owth step (d) effected at a pAg value of 6.0.
Figure 8:
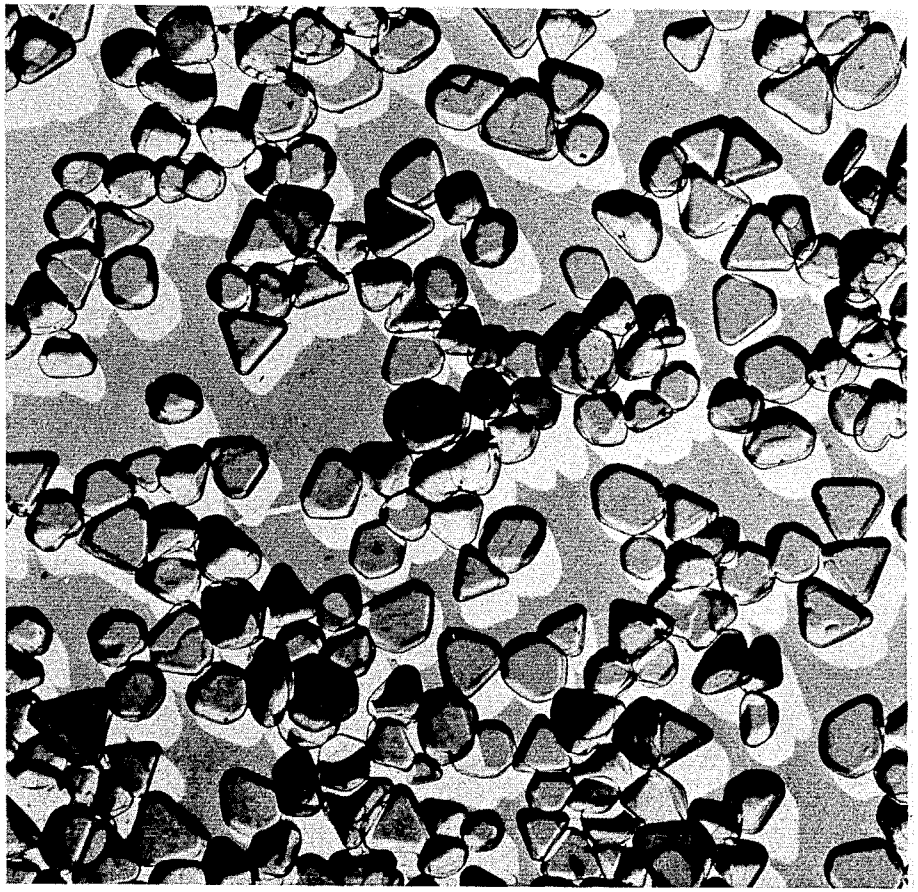
FIG. 8 shows the corresponding emulsion produced th growth step (d) effected a pAg 10 and illustrates e preparation of a monodisperse twinned octahedral nulsion.

According to a particular aspect of the present invention there is provided a process for the production of a monodisperse silver halide emulsion of the twinned type which comprises steps (a), (b) and (d) and optionally steps (c) and (e) as hereinbefore set forth and wherein in step (d) there is added further aqueous solutions of silver nitrate and ammonium or alkali metal halide at such a rate to the twinned crystals that no further nucleation of crystals occurs, the pAg being maintained at a fixed value in the range 5–12, and at a fixed temperature in the range 35°–90° C. The selection of the pAg value depends on the crystal habit required, for example FIG. 7 shows the resulting twinned cubic crystals formed when the emulsion is prepared with growth step (d) effected at a pAg value of 6.0. The monodispersity of this twinned cubic emulsion as shown in FIG. 7 is particularly high. FIG. 8 shows an example of the corresponding emulsion produced with ıe growth step (d) effected at pAg 10 and illustrates the reparation of a monodisperse twinned octahedral mulsion.

Preferably to obtain twinned monodisperse octaheral emulsions step (d) is carried out at a fixed pAg etween 9 and 11. Preferably to obtain twinned monoisperse cubic emulsions step (d) is carried out at a fixed Ag between 6 and 9 and at an ammonia concentration ithin the range 0 to 0.5 molar.

Preferably in order to produce monodisperse emulons using the process of this invention the silver iodide nulsion prepared in step (a) is itself of the monodisrse type. Such emulsions may be prepared by the ixing of aqueous solutions of a silver salt and an alkali etal or ammonium iodide in a stirred solution of a rotective colloid, at a fixed temperature and pAg. The nal crystal size of the silver iodide emulsion is preferay in the range 0.05–5.0 micron. The halide solution is eferably ammonium iodide alone, but up to approxiately 10 mole % of ammonium chloride or bromide ay be used. In order that conveniently high rates of ldition may be employed, the temperature of preparaon is preferably at least 60° C., and the pAg of the lution is maintained at a controlled value in the range 5 or in the range 11–13. Most preferably the pAg is aintained at a value of approximately 11.8±0.3. FIG. shows a silver iodide emulsion of this type. The pAg ılue may be maintained most conveniently by a suitle electrode system and automatic adjustment to the w rate of one of the solutions.

As just stated the preferred size range of the silver dide crystals prepared in step (a) is within the range of 05 to 5.0 microns. Also the silver iodide crystals prered in step (a) may be monodisperse. It has been und that the average size of the silver iodide crystals rmed in step (a) influences the size of the twinned ystals formed in step (b). In general the larger the ver iodide crystals produced in step (a) the larger the inned crystals formed in step (b).

One method of increasing the size of the silver iodide ystals formed in step (a) is to carry out step (a) in the esence of a silver iodide solvent. The solubility of the ver iodide may conveniently be controlled by varian of temperature, the quantity of excess iodide and proportion of silver iodide solvent in the dispersing dium.

It is also evident that the crystal size distribution of final twinned emulsion depends also on the crystal e distribution of the silver iodide formed in step (a). ıus although it is preferred for high-contrast applicans such as X-ray films that the silver iodide crystals in p (a) should be monodisperse, for low-contrast applicions such as monochrome camera films it may be eferred to prepare a relatively polydisperse twinned er halide emulsion according to the present process producing a relatively wide size distribution of the er iodide crystals prepared in step (a). Alternatively h a wide size distribution may be produced by blend; of monodisperse silver iodide emulsions of different e before the commencement of step (b). Thus the ıtrol of size and size distribution of the twinned silver ide crystals produced in steps (b), (c) and (d) can be ıieved by selection of the size and size distribution of silver iodide crystals formed in step (a).

The water-soluble salts during the process of the sent invention may be removed by any of the wellwn methods. Such methods often involve flocculat the silver halide and colloid dispersing agent, removing this flocculate from the then aqueous medium, washing it and redispersing it in water. The silver halide crystals may be chemically sensitised at any stage of growth by any of the well known means, for example by use of sulphur or selenium compounds or salts of the noble metals such as gold, iridium, rhodium, osmium, palladium or platinum. Often the fully grown crystals may be sensitised in this manner, so that the products of chemical sensitisation are formed on the surface of the crystals, so that such sensitised crystals would become developable in a surface developer after exposure to light. Emulsions comprising such sensitised crystals would be suitable for negative film materials. However it is sometimes required for direct positive materials, that the products of chemical sensitisation are produced in the interior of the crystal. A number of such products of chemical sensitisation may be incorporated into the body of the crystals by heating the crystals at the required stage of growth with appropriate sensitising compounds. These can include salts of non metals, such as sulphur or selenium or metals such as gold, platinum, palladium, iridium, rhodium, thallium, osmium, copper, lead, cadmium, bismuth and the like. It is also possible to effect internal reduction sensitisation by treating the crystals with reducing agents for example thiourea dioxide, hydrazine, formaldehyde or tin compounds. These compounds can either be added continuously during a part of the whole of the crystallisation process, for example by incorporating them into the feedstock solutions; or alternatively the crystallisation process can be halted, the part-grown crystals treated with the appropriate reagent, and growth recommenced.

Such internally modified crystals can be used in a variety of processes. For example, a direct-positive emulsion can be prepared using the following broadly-defined stages: (i) treating the crystal at an intermediate stage of growth in such a way as to produce centres which promote the deposition of photolytic silver (treatment with iridium or rhodium salts being particularly preferred), (ii) completion of the growth process, (iii) fogging of the crystal surface either by exposure to actinic radiation or by chemical reduction (in the preferred process the crystal is fogged by a combination of a reducing agent and a compound of a metal more electropositive than silver, such as gold or palladium). Such an emulsion, after coating, imagewise exposure, and treatment with a surface developer will yield a direct positive image. The usual additives can be applied to the direct positive emulsion if required; e.g. soluble halides to increase speed, sensitising or desensitising dyes to increase spectral range, electron trapping agents, blue speed increasing compounds and the like.

Internally modified crystals may also be prepared to provide emulsions with an enhanced ratio of internal to surface speed. Whilst a number of the previously-mentioned methods can be used, the preferred technique is to (i) precipitate a core emulsion, (ii) sensitise the surface of the core crystals using a sulphur compound and/or a gold compound as in the known art, and then (iii) grow a shell of silver halide onto the core emulsion by one of the known techniques such as Ostwald ripening in the presence of suitable ripening agents, double-jet growth, or pAg cycling through the neutral point.

For certain purposes, other techniques can produce emulsions whose internal/surface sensitivity relationship is comparable with that obtained from internal gold/sulphur sensitisation, for example doping with heavy metal ions (gold, iridium, rhodium, palladium, or lead, etc., halide conversion techniques, and halide layering techniques.

The speed of such internally sensitised emulsions may be increased by adding one or more of reagents commonly used with negative emulsions. In particular, it is possible to spectrally sensitise these emulsions with dyes of the type commonly used with surface-sensitive negative emulsions. It is advantageous in this case to use high surface coverage of dye, such as would cause desensitisation in a surface-sensitised emulsion of the same size, since the internal image is not subject to dye-induced desensitisation.

Internally sensitive emulsions can be developed using one of the techniques known in the art. These mainly involve a developer of standard type with the addition of quantities of either free iodide, or a silver halide solvent such as an alkali thiosulphate. Optionally, the surface can be bleached with an oxidising agent before development, to remove surface image (Sutherns, J. Phot. Sci. 9, 217 (1961)).

If the shell silver halide layer is thin (of the order 15 lattice planes) it is possible to develop the crystal in a surface developer; such a technique produces an emulsion yielding a conventional surface image but again avoids the desensitisation resulting from large dye additions to surface-sensitive emulsions.

By using a surface developer containing certain fogging (or nucleating) agents, such as certain substituted hydrazine compounds or certain quaternary ammonium salts, it is possible to produce a direct-positive image with the internally-sensitive emulsions described above. It may also be advantageous in this case to introduce a small degree of surface sensitivity into the crystals. Internally-sensitive emulsions may be produced by interrupting the crystal growth at any stage during the steps (a)–(d) according to the present invention, and then adding such chemical sensitising agents as those mentioned above. After such a chemical sensitisation, crystal growth is resumed so that the sensitivity centres become "buried" inside each crystal. Such techniques are well known and are described for example in British Patent Specification 1027146.

The process of the present invention can be used to prepare direct positive emulsions, using otherwise conventional technology as described, for example, in BP 723,019, and in the paper by Vanassche et al. J. Phot. Sci. 22, 121 (1974). The silver halide emulsion as prepared by the process of the present invention is fogged using a combination of a reducing agent (thiourea dioxide, hydrazine, tin salts, and several others are known) and a compound of a metal more electropositive than silver (gold and/or palladium are preferred). An electron-trapping compound, preferably one which is also a spectral sensitiser for the direct positive process, is added and the emulsion is coated. After exposure and development a surface image is revealed. It is also possible to incorporate into such emulsions one or more of the additives normally used with fogged direct positive emulsions, for example soluble halides, sensitising dyes and blue-speed increasing compounds. It is also possible to protect the surface fog from atmospheric oxidation by covering it with a thin silver halide layer, so that it is still accessible to conventional surface developers. In direct positive systems of this type cubic crystals are generally preferred, because they give better speed/and contrast.

It is to be understood that the twinned crystals formed at the end of step (b) are often very small crystals which are only of use as seed crystals. These crystals may be grown to usable size during step (d). However, as hereinbefore stated it is possible to have a prolonged step (b) so that at the end of step (b) usable crystals are produced. Nevertheless in the process of this invention step (b) may merge into step (d) without any interruption in the addition of the acqueous solutions occurring in the second mode.

However in general the twinned crystals formed at the end of step (b) are seed crystals, thus the silver iodide dissolved from the silver iodide crystals formed in step (a) will be present in the seed crystal an thus after the growth step (d) will be present in the core of the crystal unless further iodide is added during step (b). Similarly if noble metals are present in step (a) these will be included in the twinned seed crystals formed in step (b) but after the growth step (d) will be present in the final crystals as part of the core.

In order to alter the properties of the final silver halide crystals it is possible to alter the halides added during step (b) or to change completely the halides or halide ratios employed from step (b) to step (d). Thus it is possible to obtain layers of particular halide ratios in the final crystals by arranging for a particular halide or mixture of halides to be used at any stage in step (b) or in step (d) in the process of the present invention.

Where the emulsions prepared by the process of the present invention are to be used for negative working photographic material it is advantageous that after the recrystallisation step (b) or ripening step (c) (if included) the halides in step (d) are added so that up to 10 mole % iodide is precipitated in a "shell" surrounding the "core" twinned crystals formed in step (b), and that up to 10 mole % chloride is precipitated in the outermost shell of the crystals. Thus silver iodochlorobromide emulsions can be prepared according to the present invention with crystals containing "internal" iodide (in addition to that derived from the original silver iodide crystals) and "surface" chloride layers.

Where the emulsions prepared by the process of the present invention are to be used for direct positive materials or other applications where internally sensitive crystals are desired, it is advantageous that the halide precipitated during the first part or the whole recrystallisation step (b) should be predominantly chloride, and the halide precipitated during the whole or final part of the growth step (d) should be predominantly bromide. Thus silver iodochlorobromide emulsions can be prepared according to the present invention with crystals containing "internal" chloride and "surface" bromide layers.

Such "core-shell" emulsions are well known and are also described in British Patent Specification 1027146.

The silver halide crystals may be chemically sensitised in step (e) by use of any of the well known chemical sensitisers for example by the use of sulphur, noble metal compounds, or reducing agents. Examples of suitable sensitising compounds are sodium thiosulphate, and mercury, gold, tin, palladium or platinum salts.

The emulsions prepared by the process of the present invention may be optically sensitised by the addition of optical sensitisers for example carbocyanine and merocyanine dyes to the emulsions.

The emulsions may contain any of the additives commonly used in photographic emulsions for example wetting agents, such as polyalkylene oxides: stabilising agents, such as tetraazaindenes metal sequestering gents and growth or crystal habit modifying agents ommonly used for silver halide such as adenine.

Preferably the dispersing medium is gelatin or a mixıre of gelatin and a water-soluble latex for example a ıtex vinyl acrylate-containing polymer. Most preferaly if such a latex is present in the final emulsion it is dded after all crystal growth has occurred. However ther water-soluble colloids for example casein, polyviylpyrrolidone or polyvinyl alcohol may be used alone r together with gelatin.

The silver halide emulsions prepare according to the rocess of the present invention may exhibit a desirably igh covering power and contrast on development as ıown in the Examples which follow.

The silver halide emulsions prepared according to the resent invention thus are of use in many types of phoɔgraphic materials such as X-ray films, camera films oth black and white and colour, paper products and ıeir use could be extended to other materials for examle direct positive materials.

Thus the invention includes silver halide emulsions repared by the process of the present invention and oated photographic silver halide material containing at ɜast one such emulsion.

The following Examples will serve to illustrate the ıvention:

EXAMPLE 1

'reparation of twinned octahedral silver iodobromide emulsion

Preparation of monodisperse silver iodide emulsion (step a)

Figure 9:
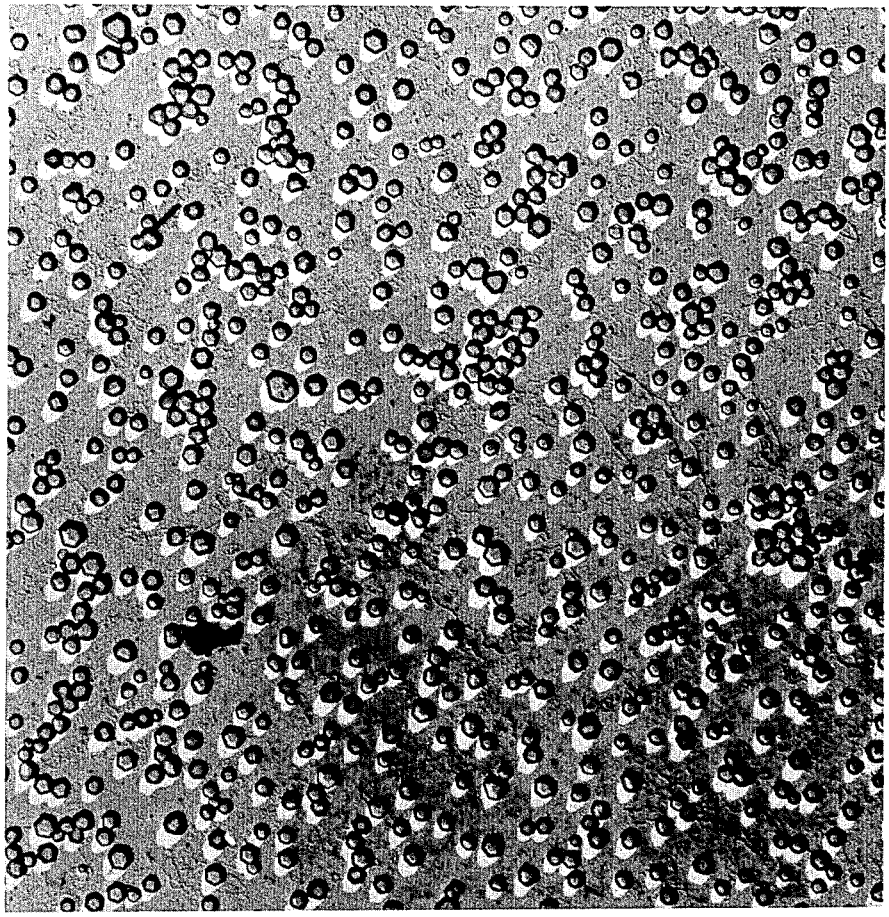
FIG. 9 shows a monodisperse silver iodide emulsion step (a).

1 liter of 5% inert gelatin was stirred at 65° C. at 200 ɔm with 0.2 ml tri-n-butyl orthophosphate as an antiɔam. Aqueous 4.7 M solutions of silver nitrate and mmonium iodide were jetted into the stirred gelatin at 000 ml per hour until 150 ml of silver nitrate solution ad been added. Then further volumes of these soluons were added at 2100 ml per hour until 525 ml of lver nitrate solution had been added. The pAg of the mulsion was maintained throughout at a value of 1.8±0.2. The crystals of this silver iodide emulsion are ıown in FIG. 9. They had a median crystal size of 0.18 ıicron.

RECRYSTALLISATION (STEP (B)

230 g of this silver iodide emulsion were added to 1 ter of 5% inert gelatin, which was stirred at 65° C. at 00 rpm with 0.2 ml tri-n-butyl orthophosphate. Aqueus 4.7 M solutions of silver nitrate and ammonium romide were jetted into the stirred silver iodide emulion at 4200 ml per hour until 500 ml of silver nitrate had een added. The pAg was maintained throughout at .0±0.5. Twinned octahedral silver iodobromide crysıls were formed.

OSTWALD RIPENING (STEP C)

The pAg of the emulsion prepared in step (b) was djusted to 9.6. 180 ml of 11.8 molar ammonia solution ıs silver halide solvent) were added, and stirring was ontinued during the Ostwald ripening. The temperaıre was maintained at 65° C. Rapid growth of tabular winned crystals and substantially complete dissolution f the remaining untwinned crystals were achieved fter 10 minutes ripening.

FURTHER GROWTH (STEP D)

The pH of the emulsion prepared in step (c) was adjusted to 5.0 with 5 N sulphuric acid so that the ammonia present was neutralised. Further 4.7 M solutions of silver nitrate and ammonium bromide were added to the emulsion stirred at 200 rpm, with the temperature maintained at 65° C. and the pAg at 9.5, at a flow rate of 3000 ml per hour until 750 ml of silver nitrate had been added. The final emulsion had a median crystal size of 0.93 micron, and a coefficient of variation of 20%.

Figure 10:
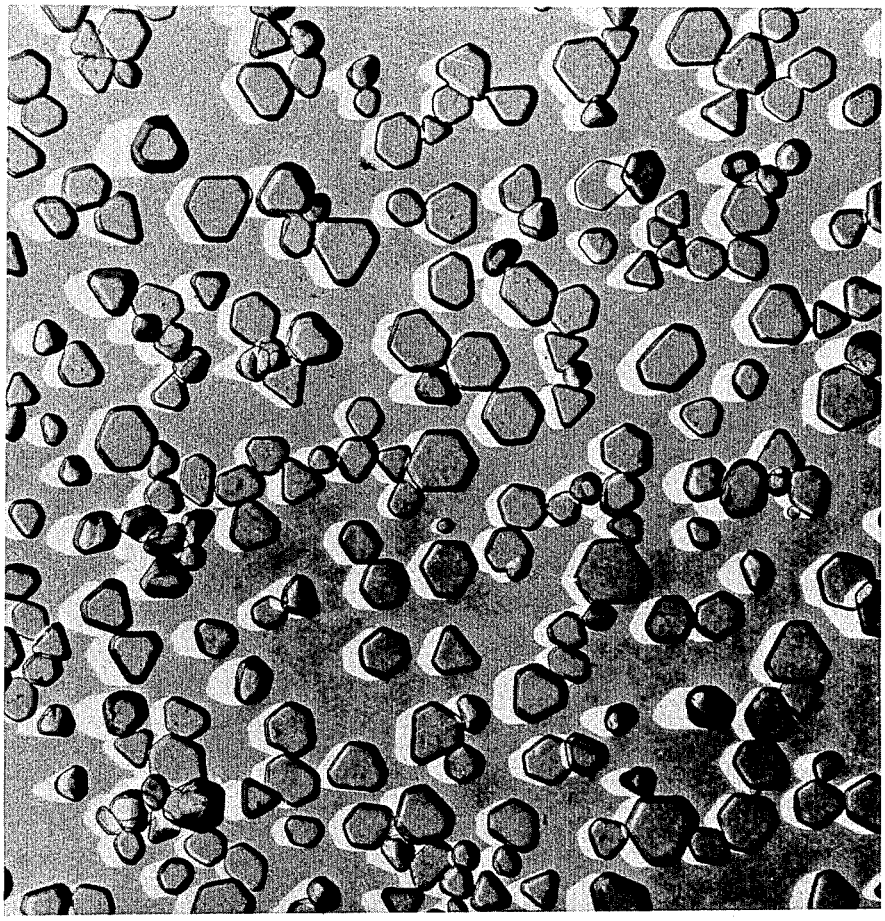
FIG. 10 shows the crystals of the final emulsion of p (d).

FIG. 10 shows the crystals of this final emulsion. It can clearly be seen from this electron micrograph that more than 50% of the crystals comprising the emulsion according to the present invention are of the tabular twinned type.

SENSITISATION OF EMULSION (STEP E)

The emulsion was flocculated using conventional techniques, washed and redispersed with a total of 210 g of limed ossein gelatin and then was digested at 57° C. for a range of times at pH 6.3 and pAg 8.8 in the presence of 4.2 mg of sodium thiosulphate and 0.6 mg of sodium tetrachloroaurate dihydrate per mole of silver halide.

The emulsion was stabilised using 7-hydroxy 5-methyl 2-methylthio 1,3,4 triazaindoline. The sensitised emulsion was then coated on to photobase at a coating weight of 40 mg Ag/dm$^2$.

PHOTOGRAPHIC RESULTS

The coated strips were then imagewise exposed for 0.2 seconds and developed for 4 minutes in a metol/hydroquinone based developer, at 20° C.

Figure 11:
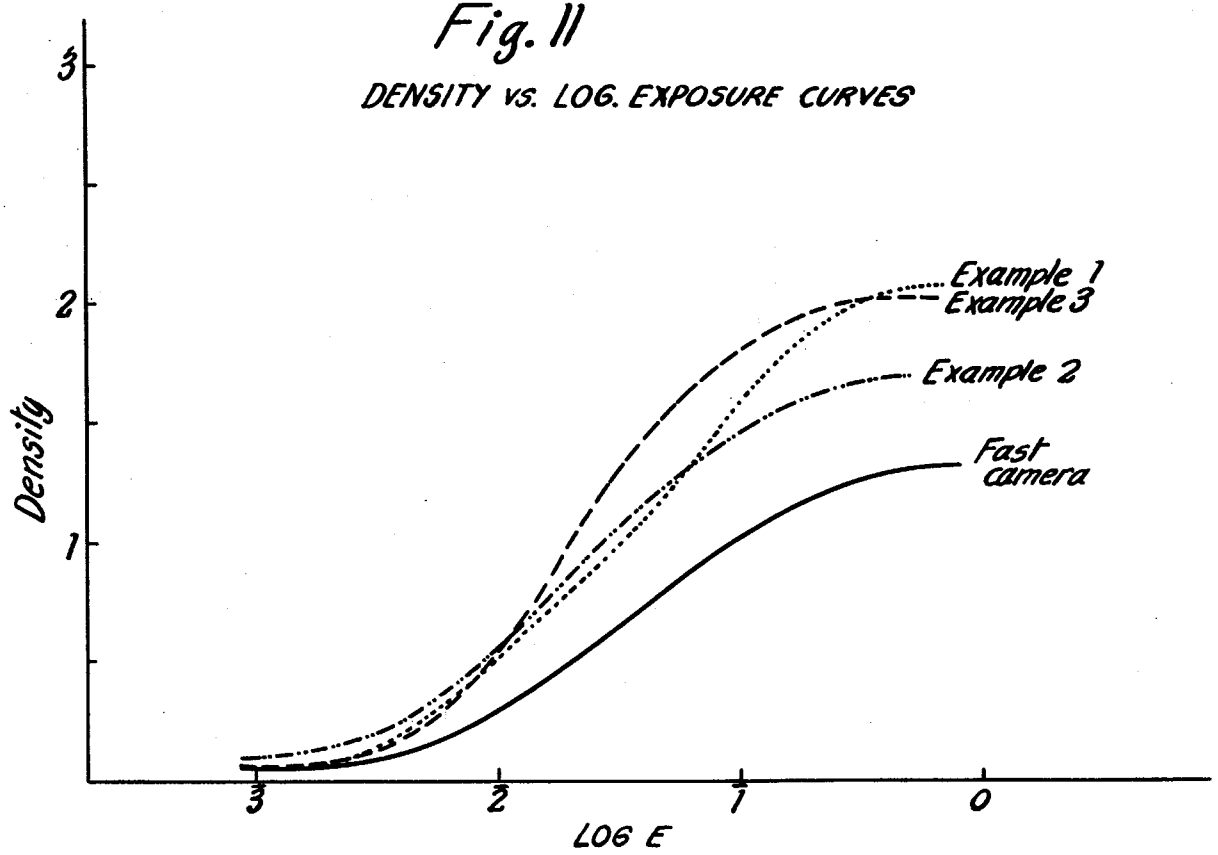
FIG. 11 shows the photographic results obtained en coated strips from step (e) are imagewise exposed 0.2 seconds and developed in a metol/hydroquinone ed developer at 20° C.

The photographic results obtained are shown in FIG. 11.

A fast camera speed silver iodobromide emulsion was used as a reference.

| EMULSION | SILVER COATING WEIGHT | $D_{MAX}$ | GAMMA (maximum) contrast |
|---|---|---|---|
| Emulsion of Example 1 (as prepared) | 40 mg/dm$^2$ | 2.1 | 1.31 |
| Fast camera | 41 | 1.4 | 0.81 |

The fast camera film used in this example is a commercial formulation made thus: 1.5 moles of 3 M silver nitrate solution were jetted into 2 liters of 1.5% gelatin solution containing 2.5 moles of 3 N ammonium bromide, 0.082 moles of 1.2 N potassium iodide and 3.07 moles of 11.8 N ammonia solution. After ripening the median linear size of the emulsion was 0.88 micron.

EXAMPLE 2

Preparation of twinned cubic silver iodobromide emulsion

This example illustrates the preparation of an emulsion in which the recrystallisation and Ostwald ripening steps are combined, and in which twinned monodisperse cubic silver iodobromide crystals are prepared.

PREPARATION OF MONODISPERSE SILVER IODIDE EMULSION (STEP A)

A monodisperse silver iodide emulsion was prepared according to step (a) of Example 1.

RECRYSTALLISATION AND RIPENING (STEPS B AND C)

230 g of the silver iodide emulsion prepared in step (a) were added to 1 liter of 5% inert gelatin, which was stirred at 200 rpm at 65° C. with 0.2 ml tri-n-butyl orthosphate. Aqueous 4.7 M solutions of silver nitrate and the ammonium bromide were jetted into the stirred silver iodide emulsion at the rate of 3000 ml per hour until 500 ml of silver nitrate had been added. The pAg was maintained throughout at 7.7±0.3.

Ostwald ripening was effected by the presence of 100 ml of 11.8 M ammonia solution, added with the halide solutions so that as recrystallisation of the silver iodide occurred, the concentration of ammonia increased. At the end of the addition of silver nitrate and ammonium halide solutions, dissolution of untwinned crystals by Ostwald ripening was substantially complete, and predominantly twinned crystals of silver iodobromide remained.

FURTHER GROWTH (STEP D)

The pH of the emulsion prepared in the combined steps (b) and (c) was adjusted to 5.0 with 5 N sulphuric acid. Further 4.7 M solutions of silver nitrate and ammonium bromide were added as follows, so that, in total, 3000 ml of silver nitrate solutions were added in this step;

| FLOW RATE | VOLUMES OF SOLUTIONS ADDED |
|---|---|
| 2400 ml/hr | 1000 ml |
| 4200 ml/hr | 2000 ml |

The pAg was mainted throughout at 6.0±0.5.

Figure 12:
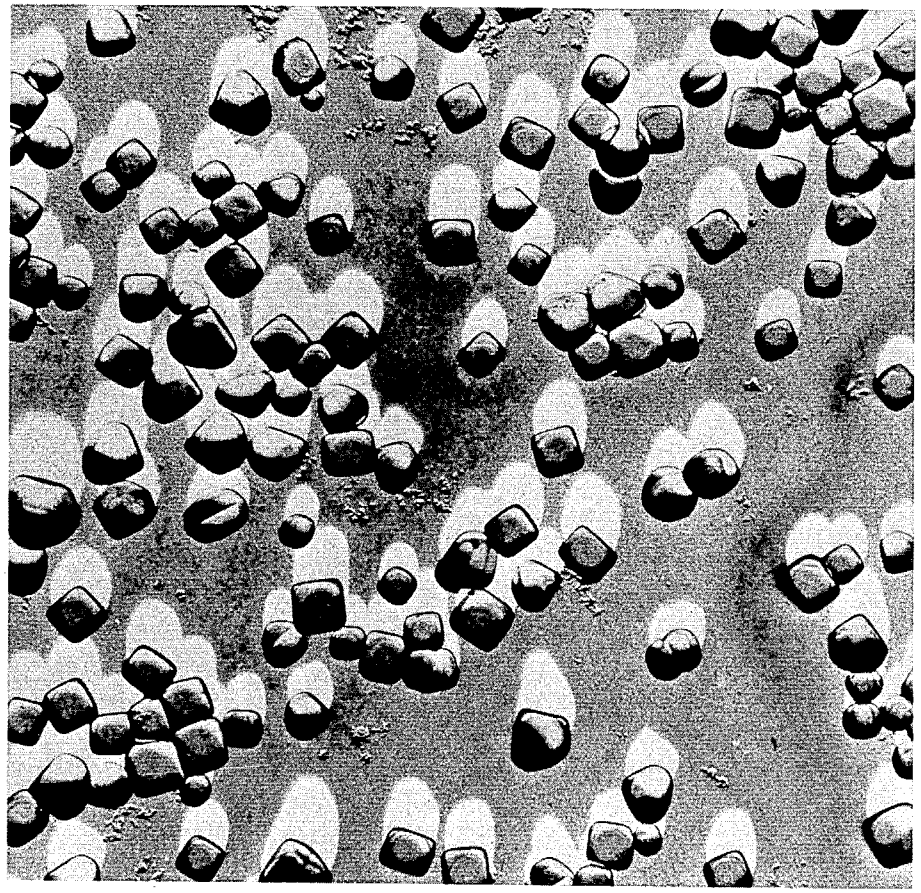
FIG. 12 shows the crystals of a final emulsion in step

The final monodisperse emulsion had a median crystal size of 1.15 micron, and a coefficient of variation of 15%. FIG. 12 shows the crystals of the final emulsion. The two types of twinned cubic crystals, those containing parallel twin planes and those containing single twin planes respectively, can clearly be seen.

SENSITISATION OF EMULSION (STEP E)

The emulsion was flocculated using conventional techniques, washed and redispersed with a total of 210 g of limed ossein gelatin and was then digested at 57° C. for a range of times at pH 6.3 and pAg 8.8 in the presence of 7 mg of sodium thiosulphate per mole of silver halide, and 0.6 mg of sodium tetrachloroaurate dihydrate per mole of silver halide. The emulsion was stabilised using 7-hydroxy 5-methylthio 1,3,4 triazaindoline. The sensitised emulsion was then coated on to photobase strips at a coating weight of 40 mg Ag/dm$^2$.

PHOTOGRAPHIC RESULTS

The coated strips were imagewise exposed for 0.2 seconds and developed in a metol/hydroquinone based developer, at 20° C. The photographic results are also shown in FIG. 11, compared with a fast camera speed emulsion used as a reference.

| EMULSION | SILVER COATING WEIGHT | $D_{MAX}$ | GAMMA |
|---|---|---|---|
| Emulsion of Example 2 | 40 mg/dm$^2$ | 1.7 | 1.09 |
| Fast camera | 41 mg/dm$^2$ | 1.4 | 0.81 |

EXAMPLE 3

This Example illustrates the preparation of an emulsion in which twinned monodisperse silver iodochlorobromide crystals of the intermediate tetradecahedral habit are prepared.

PREPARATION OF MONODISPERSE SILVER IODIDE EMULSION (STEP A)

A monodisperse silver iodide emulsion was prepared according to step (a) of Example 1.

RECRYSTALLISATION AND OSTWALD RIPENING (STEPS B AND C)

230 g of the silver iodide emulsion prepared in step (a) were added to 1 liter of 5% inert gelatin, which was stirred at 65° C. at 200 rpm with 0.2 ml tri-n-butyl orthophosphate. Aqueous 4.7 M solutions of silver nitrate and of a mixture of 4.7 M ammonium bromide and chloride solutions in the molar ratio of 66:34 were jetted into the stirred silver nitrate solutions at 9000 ml per hour until 150 ml of silver nitrate solution had been added, and double-jetting was then continued at 3000 ml per hour until a further 300 ml of silver nitrate solution had been added. The pAg was maintained throughout at 7.7±0.3.

100 ml of 11.8 M ammonia were added with the halide solutions during this step as the silver halide solvent (as in Example 2).

FURTHER GROWTH (STEP D)

The pH of the emulsion prepared in the combined steps (b) and (c) was adjusted to 5.0 with 5 N sulphuric acid. Further 4.7 M solutions of silver nitrate and of ammonium bromide and chloride in the molar ratio 66:34 were added as follows:

| FLOW RATE | VOLUMES OF SOLUTIONS ADDED |
|---|---|
| 3600 ml/hr | 500 ml |
| 5400 ml/hr | 1000 ml |
| 7800 ml/hr | 1334 ml |

The pAg was maintained throughout at 8.6±0.3.

Figure 13:
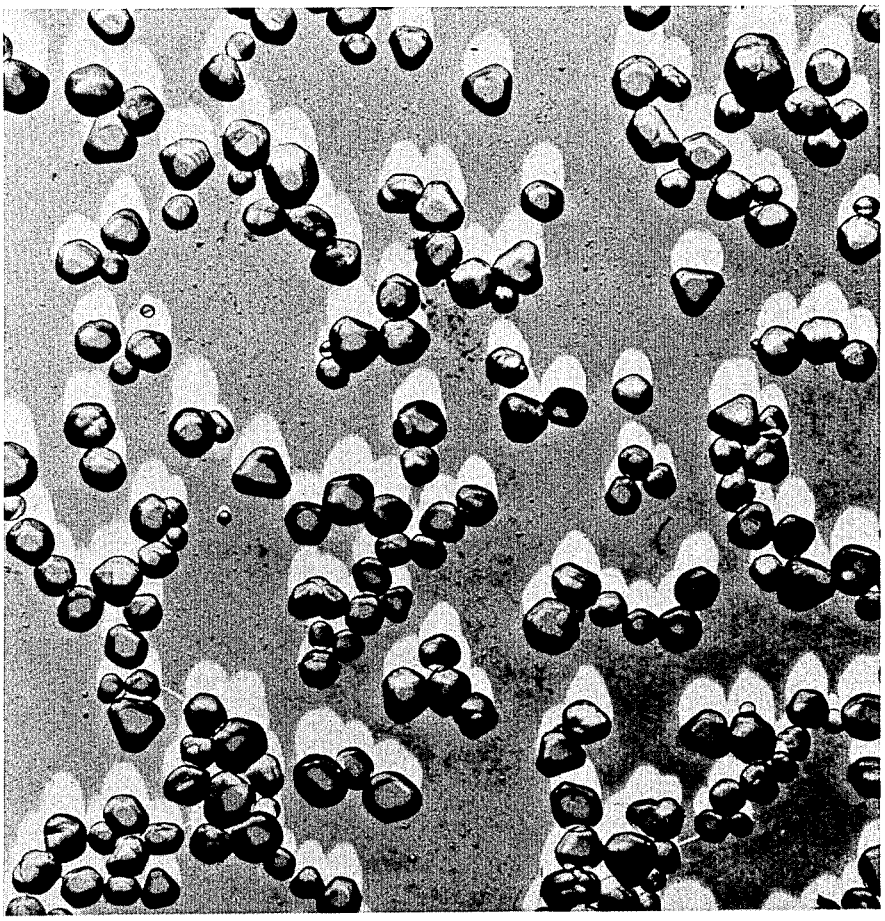
FIG. 13 shows the crystals of the final monosized ulsion, having a mean liner crystal size of 0.97 min and a coefficient of size variatiion of 20%.

FIG. 13 shows the crystals of the final monasized emulsion, which had a mean linear crystal size of 0.97 micron, and a coefficient of size variation of 20%. It can clearly be seen that the twinned silver iodochlorobromide crystals of the emulsion produced were mainly of the intermediate, tetradecahedral habit.

SENSITISATION OF EMULSION (STEP E)

The emulsion was flocculated using conventional techniques, washed and redispersed with a total of 210 g of limed ossein gelatin, and was then digested at 52° C. for a range of times at pH 5.6 and pAg 7.9 in the presence of 7.0 mg of sodium thiosulphate and 1.2 mg of sodium tetrachloroaurate dihydrate per mole of silver halide. The emulsion was stabilised using 7-hydroxy 5-methylthio 1,3,4 triazaindoline. The sensitised emulsion was then coated on to photo base strips at a coating weight of 40 mg Ag/dm$^2$.

PHOTOGRAPHIC RESULTS

The coated strips were imagewise exposed for 0.2 seconds and developed in a metol/hydroquinone based developer, at 20° C.

The photographic results are also shown in FIG. 11, compared with the fast camera speed emulsion used as a reference:

| EMULSION | SILVER COATING WEIGHT | $D_{MAX}$ | GAMMA |
|---|---|---|---|
| Emulsion of example (as prepared) | 40 mg/dm$^2$ | 2.0 | 1.80 |
| Fast camera | 41 | 1.4 | 0.81 |

DISCUSSION OF PHOTOGRAPHIC RESULTS

The photographic results of the emulsions prepared in Examples 1 to 3 show that they are of high photographic sensitivity, exhibit high covering power and high contrast.

EXAMPLE 4

This Example illustrates the preparation of an emulsion according to the second mode, and in which the only silver halide solvent present is the excess halide contained in the dispersing medium, that is, step (c) is omitted. In this Example twinned monodisperse octahedral silver iodobromide emulsions are prepared.

PREPARATION OF MONODISPERSE SILVER IODIDE EMULSION (STEP A)

A monodisperse silver iodide emulsion was prepared according to step (a) of Example 1.

RECRYSTALLISATION (STEP B)

812 g of the silver iodide emulsion prepared in step (a) were added to 500 ml of distilled water containing 120 g of inert, limed ossein gelatin, which was stirred at 65° C. at 200 rpm with 0.2 ml tri-n-butyl orthophosphate. Aqueous 4.7 M solutions of silver nitrate and ammonium bromide were jetted into the stirred silver iodide emulsion as follows, after adjustment of the pAg to 8.6.

| FLOW RATE | VOLUMES OF SOLUTIONS ADDED |
|---|---|
| 600 ml/hr | 200 ml |
| 960 ml/hr | 400 ml |
| 1500 ml/hr | 800 ml |

120 ml distilled water containing 80 g of inert gelatin was then added, and double-jetting was then continued at 1500 ml/hr until a further 400 ml of silver nitrate solution had been added. The pAg was maintained throughout at 8.6±0.3.

A portion of the silver halide emulsion was then examined under a microscope and substantially no untwinned silver halide crystals were observed. Thus step (b) had been carried out so that the rate of addition of the silver salt and the rate of addition of the ammonium bromide were such that the silver halide crystals formed at the end of the step were predominantly twinned.

FURTHER GROWTH (STEP D)

Figure 14:
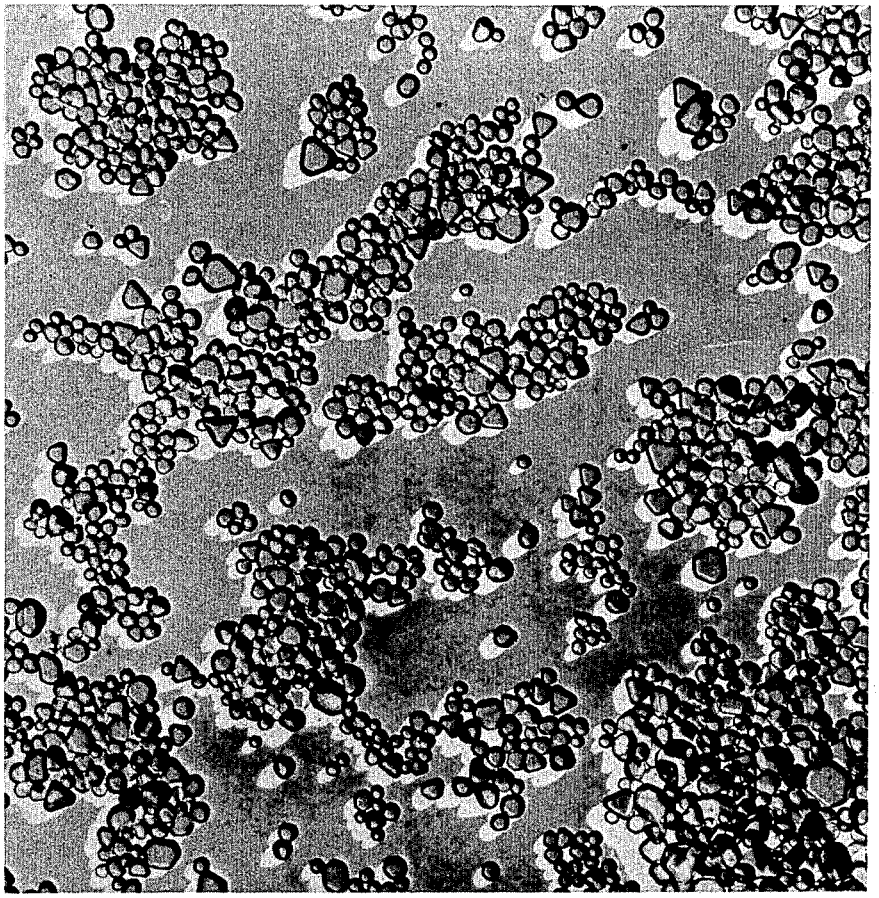
FIG. 14 shows the crystals of the final monosized ulsion having a mean linear crystal size of 0.14 min and a coefficient of variation of 16%.

The pAg was adjusted to 9.6. Further 4.7 M solutions of silver nitrate and ammonium bromide were added to the emulsion stirred at 200 rpm, with the temperature maintained at 65° C. and the pAg at 9.8, at a flow rate of 600 ml/hr until a further 2000 ml of silver nitrate solution had been added. The final emulsion had a median crystal size of 0.54 micron, and a coefficient of variation of 16%. FIG. 14 shows the crystals of this final emulsion. It can clearly be seen from this electron micrograph that the crystals of the emulsion produced were predominantly of the twinned type.

SENSITISATION OF EMULSION (STEP E)

The emulsion was flocculated using conventional techniques, washed and redispersed with a total of 210 g of limed ossein gelatin and then was digested at 57° C. for a range of times at pH 6.3 and pAg 8.8 in the presence of 14 mg of sodium thiosulphate and 2.6 mg of sodium tetrachloroaurate dihydrate per mole of silver halide. The emulsion was stabilised using 7-hydroxy 5-methyl 2-methylthio 1,3,4,-triazaindoline. The sensitised emulsion was then coated on to photobase at a coating weight of 24 mg Ag/dm$^2$.

PHOTOGRAPHIC RESULTS

The coated strips were then imagewise exposed for 0.02 seconds and developed for 4 minutes in a metol/hydroquinone-based developer at 20° C.

Figure 15:
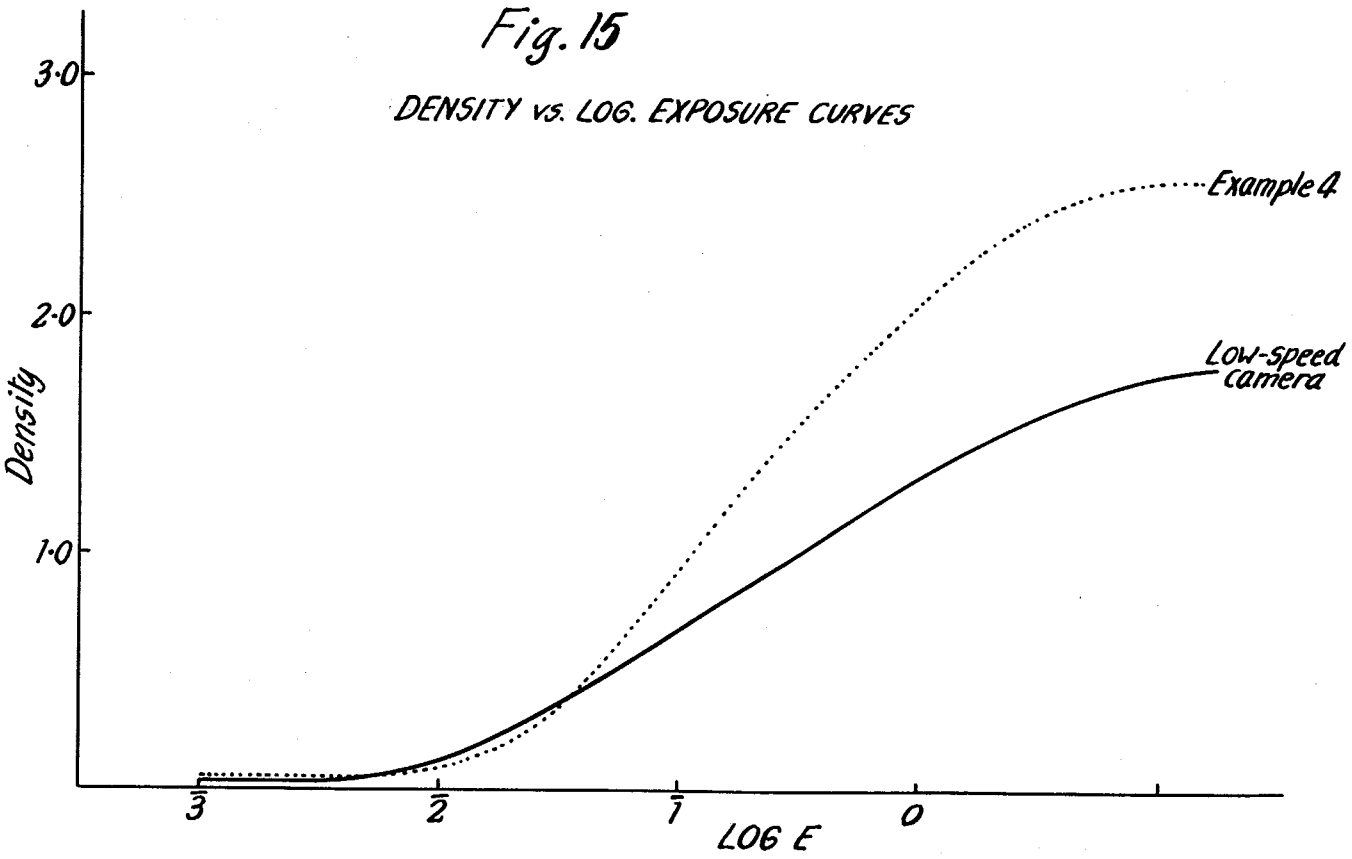
FIG. 15 shows the photographic results obtained en coated strips from step (e) are imagewise exposed for 0.02 seconds and developed for 4 minutes in a metol/hydroquinone based developer at 20° C.

The photographic results obtained are shown in FIG. 15, compared with a low-speed camera emulsion used as a reference:

| EMULSION | SILVER COATING WEIGHT | $D_{MAX}$ | GAMMA |
|---|---|---|---|
| Emulsion of example 4 (as prepared) | 24 mg/dm$^2$ | 2.6 | 1.43 |
| Low-speed camera | 22 | 1.9 | 0.84 |

The low speed camera film used in this example is a commercial formulation made thus: 1.5 moles of 3 M silver nitrate solution was jetted into 3 liters of 3.3% gelatin solution containing 2.25 moles of 3 M ammonium bromide, 0.11 moles of 1.2 M potassium iodide and 2.8 moles of 11.8 M ammonia solution. After ripening the median linear size of the emulsion was 0.50 micron.

DISCUSSION OF PHOTOGRAPHIC RESULTS

The photographic results of the emulsion prepared in Example 4 show that a speed comparable with the reference emulsion is obtained, with enhanced covering power and higher contrast.

I claim as my invention:

1. A method of preparing a silver halide emulsion of the twinned type which comprises the steps of (a) forming in a colloid dispersing medium silver halide crystals containing at least 90 mole % iodide these said crystals being predominantly of the hexagonal lattice structure, (b) mixing in the dispersing medium containing the said silver halide crystals an aqueous solution of a silver salt and an aqueous solution of an alkali metal or ammonium bromide or chloride or mixtures thereof so forming twinned silver halide crystals containing iodide and the halide or halides being added, the rate of addition of silver salt and alkali metal or ammonium bromide being so controlled that the silver halide crystals formed in this step are predominantly twinned and optionally (d) then causing the twinned crystals to increase in size by adding to the colloidal dispersion further aqueous silver salt solution and further alkali metal or ammonium halide and then finally optionally (e) removing the water-soluble salts formed and chemically sensitising the emulsion.

2. A method according to claim 1 wherein the final emulsion is of the twinned octahedral type.

3. A method according to claim 1 wherein the final emulsion is of the twinned cubic type.

4. A method according to claim 1 wherein the silver iodide content in the dispersing medium at the commencement of step (b) is in the range of 0.05 to 2.0 moles/liter.

5. A method according to claim 4 wherein the silver iodide content in the colloid dispersing medium at the commencement of step (b) is in the range of 0.10 to 1.0 mole/liter.

6. A method according to claim 1 wherein the median linear size of the silver iodide crystals formed in step (a) is within the range of 0.05 to 5 microns.

7. A method according to claim 6 wherein the median linear size of the silver iodide crystals is within the range of 0.1 to 1.0 microns.

8. A method according to claim 1 wherein step (b) aqueous 3–5 M solutions of silver nitrate and ammonium bromide or ammonium chloride are added to a stirred dispersion of silver iodide in gelatin solution, at a fixed temperature and pAg maintained in the range of 5.0 to 11.0.

9. A method according to claim 8 wherein the pAg range is from 6.0 to 10.0.

10. A method according to claim 8 wherein the temperature is maintained at a fixed value between 35° to 90° C.

11. A method according to claim 1 where in step (b) the flow rate of the silver salt is maintained constant as predetermined by experiment.

12. A method according to claim 1 where in step (b) the volumes of silver salt and ammonium or alkali metal halides are added such that the silver iodide comprises from 0.01 to 20 mole % of the total silver halide in the final emulsion.

13. A method according to claim 1 wherein step (a) is carried out in the presence of a silver iodide solvent.

14. A method according to claim 1 wherein step (a) is carried out in the presence of a noble metal or sulphur or selenium salt or a reducing agent.

15. A method according to claim 14 wherein the noble metal is iridium. twinned silver halide crystals containing iodide and the halide or halides being added, the rate of addition of silver salt and alkali metal or ammonium bromide being so controlled that the silver halide crystals formed in this step are predominantly twinned and optionally (d) then causing the twinned crystals to increase in size by adding to the colloidal dispersion further aqueous silver salt solution and further alkali metal or ammonium halide and then finally optionally (e) removing the water-soluble salts formed and chemically sensitising the emulsion.

16. A method according to claim 1 wherein step (b) is carried out in the presence of a fixed concentration of excess halide.

17. A silver halide emulsion prepared by the method of any claim 1.

18. Photographic silver halide material which comprises at least one silver halide emulsion as claimed in claim 17.

19. A method of preparing a monodisperse silver halide emulsion of the twinned type which consists essentially of steps (a), (b), (d), and optionally (e) as defined in claim 1 wherein, in step (d) there is added further aqueous solutions of silver nitrate and ammonium or alkali halide at such a rate to the twinned crystals that no further nucleation of crystals occurs, the pAg of the solution being maintained at a fixed value in the range 5–12, and the temperature of the solution being maintained constant in the range 35°–90° C.

* * * * *

UNITED STATES PATENT AND TRADEMARK OFFICE

CERTIFICATE OF CORRECTION

PATENT NO. : 4,184,877

DATED : January 22, 1980

INVENTOR(S) : Trevor James Maternaghan

It is certified that error appears in the above-identified patent and that said Letters Patent are hereby corrected as shown below:

Claim 15

Column 22, lines 7 to 17, delete from

"twinned silver halide crystals to end of claim".

Signed and Sealed this

*Thirteenth* Day of *May 1980*

[SEAL]

*Attest:*

SIDNEY A. DIAMOND

*Attesting Officer*

*Commissioner of Patents and Trademark*